US007258553B2

(12) United States Patent
McClelland

(10) Patent No.: US 7,258,553 B2
(45) Date of Patent: Aug. 21, 2007

(54) SEALED ELECTRICAL CONNECTOR ASSEMBLY

(75) Inventor: Timothy R. McClelland, Bolingbrook, IL (US)

(73) Assignee: Molex Incorporated, Lisle, IL (US)

( * ) Notice: Subject to any disclaimer, the term of this patent is extended or adjusted under 35 U.S.C. 154(b) by 0 days.

(21) Appl. No.: 11/515,680

(22) Filed: Sep. 5, 2006

(65) Prior Publication Data

US 2007/0004247 A1 Jan. 4, 2007

Related U.S. Application Data

(63) Continuation of application No. 11/131,673, filed on May 18, 2005, now Pat. No. 7,101,196.

(51) Int. Cl.
*H01R 13/52* (2006.01)

(52) U.S. Cl. ..... 439/74; 439/521; 439/559

(58) Field of Classification Search ..... 439/74, 439/521, 559, 65, 271–283, 519, 556
See application file for complete search history.

(56) References Cited

U.S. PATENT DOCUMENTS

| | | | |
|---|---|---|---|
| 4,473,267 | A | 9/1984 | Sadigh-Behzadi |
| 4,676,574 | A | 6/1987 | Grosso et al. |
| 4,822,293 | A | 4/1989 | Robson |
| 5,125,848 | A | 6/1992 | Zimmerly |
| 5,186,635 | A | 2/1993 | Pechulis et al. |
| 5,464,355 | A | 11/1995 | Rothenberger |
| 5,766,026 | A | 6/1998 | Cooper et al. |
| 6,116,952 | A | 9/2000 | Nakata |
| 6,358,063 | B1 | 3/2002 | Neidich |
| 6,592,384 | B2 | 7/2003 | Sawayanagi |
| 6,695,622 | B2 | 2/2004 | Korsunsky et al. |
| 7,011,539 | B1 * | 3/2006 | Nagy et al. ..... 439/271 |

* cited by examiner

*Primary Examiner*—Gary F. Paumen
(74) *Attorney, Agent, or Firm*—Charles S. Cohen

(57) ABSTRACT

A sealed electrical connector assembly is provided for mounting between a pair of printed circuit boards. The assembly includes a first electrical connector having a dielectric housing mounting a plurality of conductive terminals which have tail portions connected to appropriate circuit traces on a first printed circuit board. A second electrical connector is mateable with the first connector and has a dielectric housing mounting a plurality of conductive terminals which have tail portions connected to appropriate circuit traces on a second printed circuit board which is spaced from and generally parallel to the first printed circuit board when the connectors are mated. An open-ended, generally hollow shroud is provided independent of and surrounding the mated connectors between the parallel printed circuit boards. The peripheral edges of the open ends of the shroud are resilient and are in engagement with opposing surfaces of the parallel printed circuit boards to seal the mating connectors disposed within the shroud from the outside environment.

8 Claims, 3 Drawing Sheets

FIG.3a
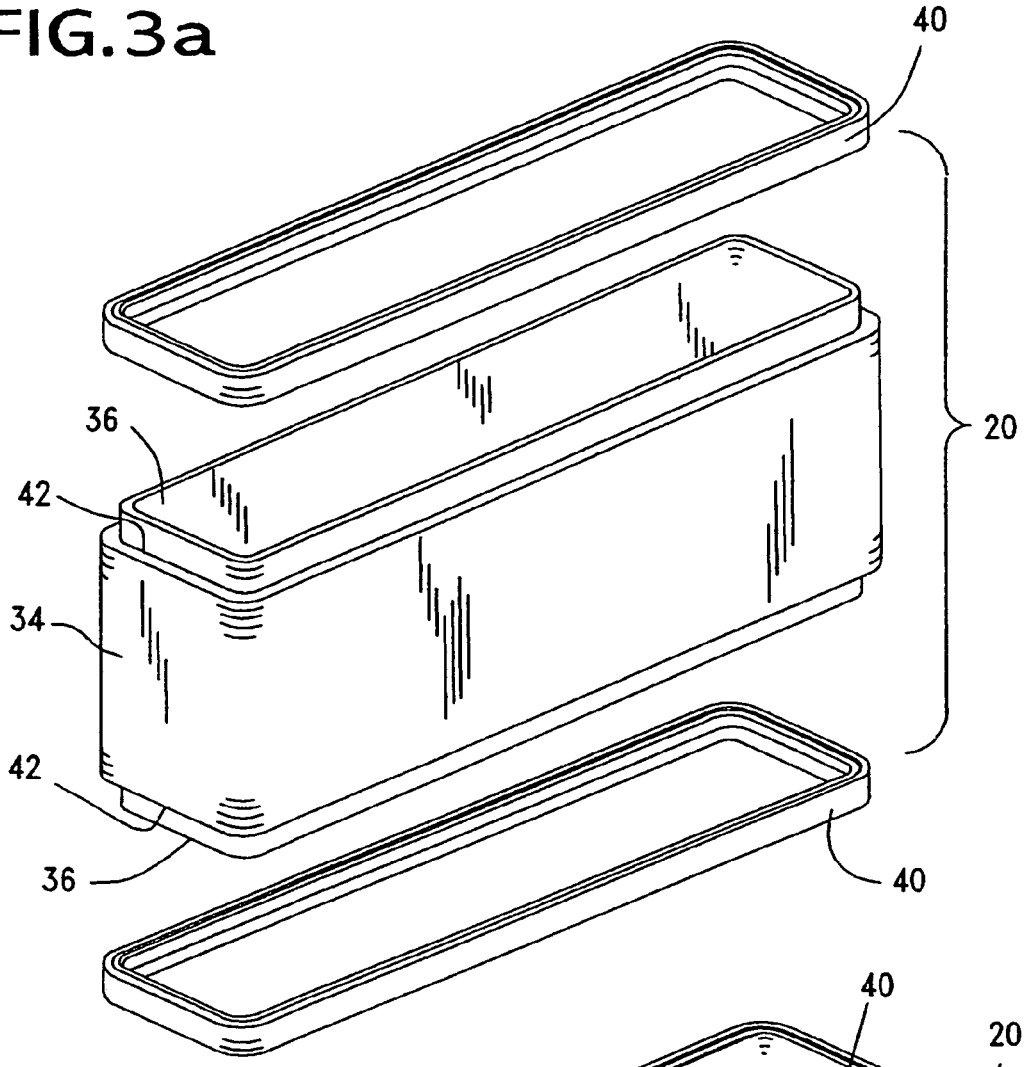
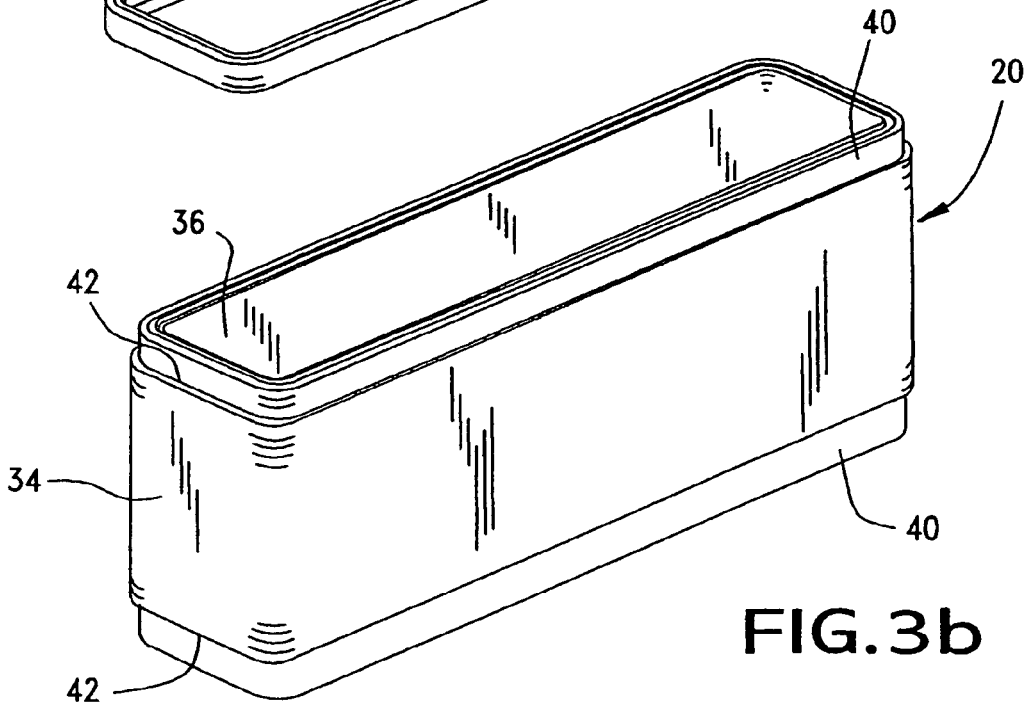
FIG.3b

SEALED ELECTRICAL CONNECTOR ASSEMBLY

FIELD OF THE INVENTION

This invention generally relates to the art of electric connectors and, particularly, to a sealed electrical connector assembly for mounting between a pair of printed circuit boards.

BACKGROUND OF THE INVENTION

Generally, an electrical connector includes some form of dielectric or insulative housing which mounts one or more conductive terminals. The housing is configured for mating with a complementary mating connector or other connecting device which, itself, has one or more conductive terminals. A connector assembly typically includes a pair of mating connectors, such as plug and receptacle connectors sometimes called male and female connectors.

Various types of electrical connectors are designed for mounting on a printed circuit board. The connectors have terminals which include contact portions for engaging the terminals of a complementary mating connector. The terminals of a board-mounted connector having terminating ends for connection to appropriate circuit traces on the circuit board, such as solder tails for solder connection to the circuit traces on a top surface of the circuit board and/or in holes in the board.

Still further, some electrical connector assemblies or mating connectors must be sealed from contaminants in the environment. One prior sealing method has been to employ a gasket between a pair of abutting edges of the two mating connectors. Another method has been to construct the mating connectors with mating edges that slide over each other forming overlapping walls. A further method has been to provide a flexible boot surrounding each connector, with the mating edges of the boots engaging each other in compression. While all of these prior methods work well for their intended purposes, each method requires major modifications to the connectors and, therefore, add considerable costs in manufacturing the connectors. The sealing problems are further magnified in applications where a pair of electrical connectors are mounted between a pair of generally parallel printed circuit boards. The present invention is directed to solving these problems by providing an extremely simple but very effective system for sealing two mating connectors disposed between two printed circuit boards.

SUMMARY OF THE INVENTION

An object, therefore, of the invention is to provide a new and improved, sealed electrical connector assembly mounted between a pair of printed circuit boards.

In the exemplary embodiment of the invention, the assembly includes a first electrical connector having a dielectric housing mounting a plurality of conductive terminals which have tail portions connected to appropriate circuit traces on a first printed circuit board. A second electrical connector is mateable with the first connector and has a dielectric housing mounting a plurality of conductive terminals which have tail portions connected to appropriate circuit traces on a second printed circuit board which is spaced from and generally parallel to the first printed circuit board when the connectors are mated. An open-ended, generally hollow shroud is provided independent of and surrounding the mated connectors between the parallel printed circuit boards. The peripheral edges of the open ends of the shroud are resilient and are in engagement with opposing surfaces of the parallel printed circuit boards to seal the mating connectors disposed within the shroud from the outside environment.

According to some aspects of the invention, the shroud has a length between its open ends designed to place the resilient edges of the shroud under compression when the connectors are mated. The resilient edges of the shroud are provided by gaskets secured about the edges of the open ends of the shroud.

Other features of the invention include interengaging latch means between the housing of at least one of the two connectors and the shroud to hold the shroud about the one connector in engagement with its respective printed circuit board prior to mating the connectors. Interengaging latch means also are provided between the housings of the first and second connectors to hold the connectors in mated condition.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

FIG. 3*a* is an exploded perspective view of the shroud for sealing the first and second connectors mated between the first and second printed circuit boards;

FIG. 3*b* is a perspective view of the assembled shroud for sealing the first and second connectors mated between the first and second printed circuit boards;

DETAILED DESCRIPTION OF THE PREFERRED EMBODIMENT

Figure 1:
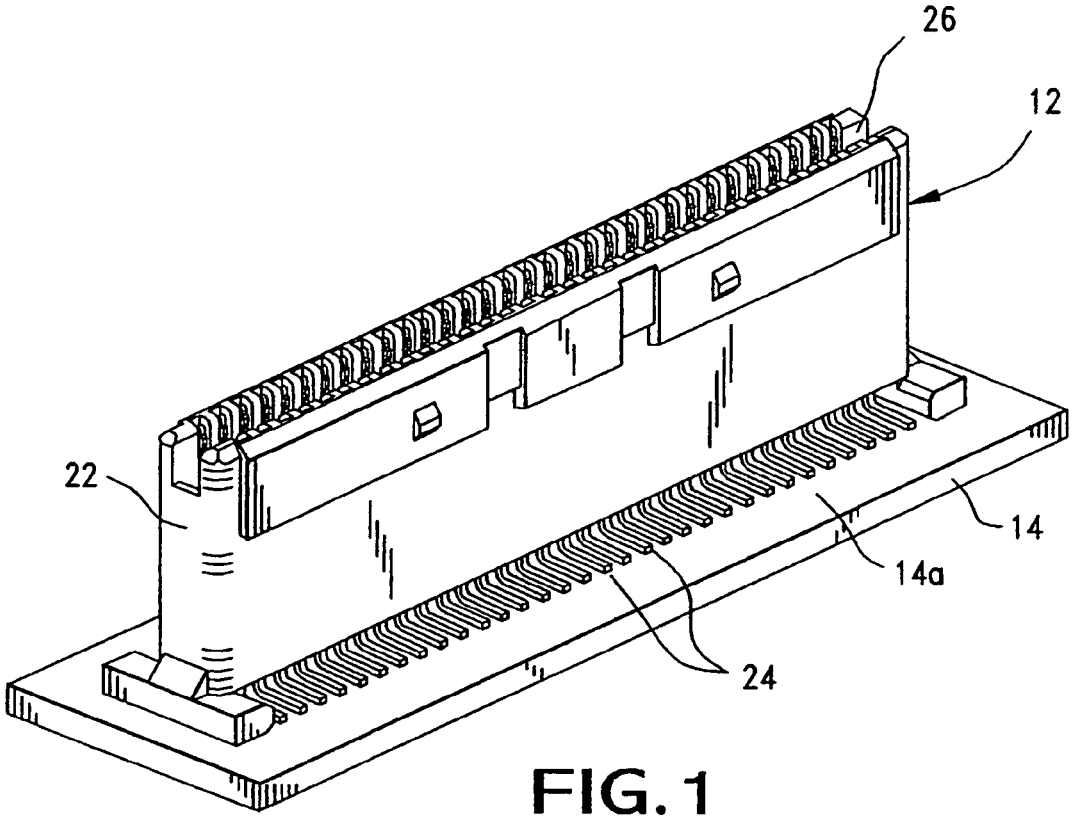
FIG. 1 is a perspective view of a first or receptacle connector mounted on a first printed circuit board according to the invention.

Referring to the drawings in greater detail, the invention is embodied in a sealed electrical connector assembly, generally designated 10 (FIG. 5), which includes a first or receptacle connector, generally designated 12, which is mounted to a first printed circuit board 14 and which is mateable with a second or plug connector, generally designated 16 (FIG. 2) which is mounted on a second printed circuit board 18. An open-ended, generally hollow shroud, generally designated 20 (FIG. 3), is sandwiched between the two circuit boards 14 and 18 to seal the mated connectors 12 and 16 therewithin from contaminants in the outside environment.

Figure 5:
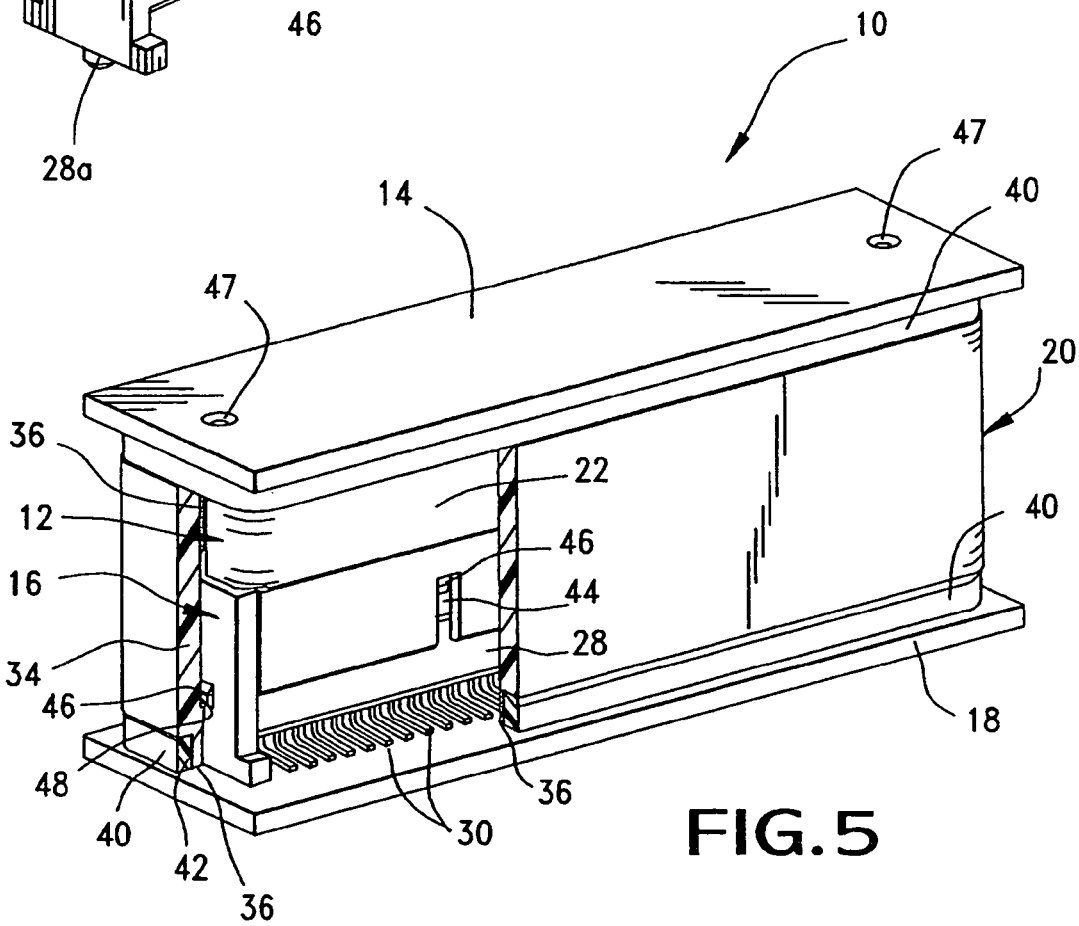
FIG. 5 is a perspective view of the sealed electrical connector assembly of the invention, partially cut-away to show the mating connectors therewithin.

More particularly, referring to FIG. 1 in conjunction with FIG. 5, the first or receptacle connector 12 includes a generally rectangular dielectric housing 22 mounting a plurality of conductive terminals which have tail portions 24 that are connected, as by soldering, to appropriate circuit traces on a surface 14*a* of first printed circuit board 14. Housing 22 of receptacle connector 12 includes a mating receptacle portion 26 for receiving a mating plug portion (described below) of the second or plug connector 16.

Figure 2:
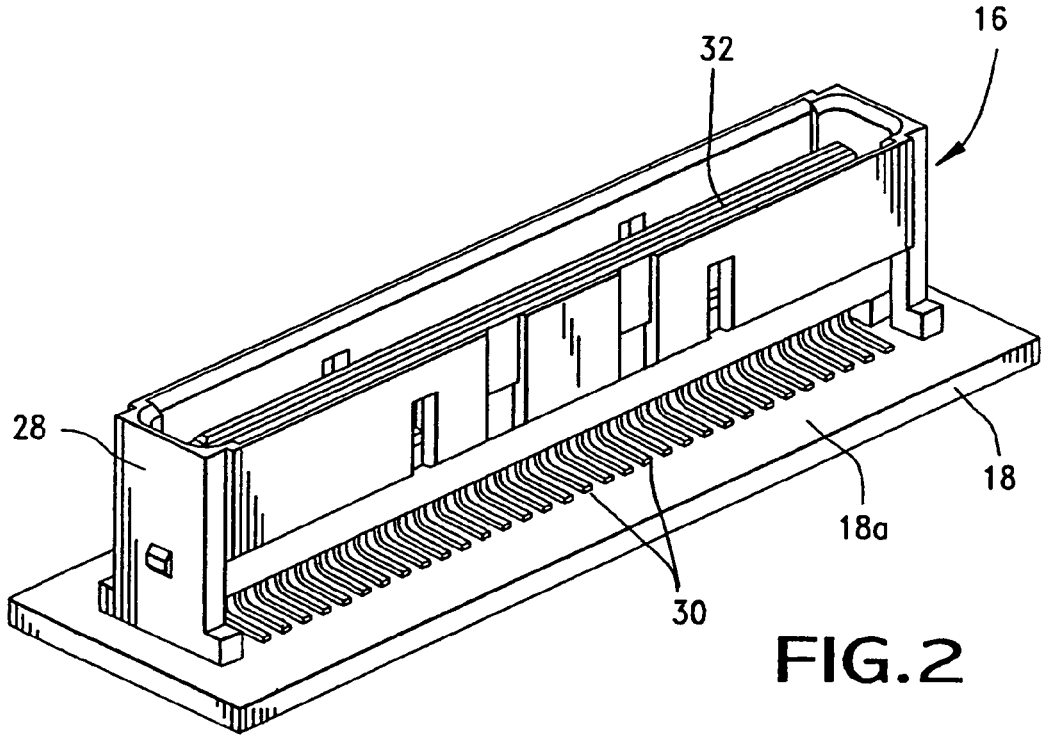
FIG. 2 is a second or plug connector mounted on a second printed circuit board and which is mateable with the first connector of FIG. 1.

Referring to FIG. 2 in conjunction with FIG. 5, the second or plug connector 16 includes a generally rectangular dielectric housing 28 mounting a plurality of conductive terminals having tail portions 30 that are connected, as by soldering, to appropriate circuit traces on a surface 18*a* of second printed circuit board 18. Housing 28 of plug connector 16 includes a mating plug portion 32 which is inserted into mating receptacle portion 26 of receptacle connector 12 when the two connectors are mated as shown in FIG. 5. When the connectors are fully mated, it can be seen that the two printed circuit boards 14 and 18 are generally parallel to each other.

Referring to FIGS. 3*a* and 3*b* in conjunction with FIG. 5, shroud 20 is elongated and generally rectangular to surround the rectangular connectors 12 and 16 when the connectors are fully mated. The shroud includes a body 34 fabricated of dielectric material such as plastic or the like. The shroud or body has opposite open ends 36.

Generally, the peripheral edges of the open ends 36 of shroud 20 are resilient and are maintained in engagement with the opposing surfaces 14*a* and 18*a* of the parallel printed circuit boards 14 and 18, respectively, to seal mating connectors 12 and 16 disposed within the shroud from contaminants in the outside environment. In the preferred embodiment of the invention, as seen in FIGS. 3*a* and 3*b*, the resilient edges of the shroud are provided by resilient gaskets 40 secured about the edges of the open ends 36 of the shroud. As seen in FIG. 3*a* and FIG. 5, the outside surfaces of body 34 of shroud 20 are recessed, as at 42, surrounding open ends 36. Gaskets 40 are positioned within recesses 42 so that end portions of the gaskets project at least slightly beyond open ends 36 of the shroud body. Therefore, by designing the shroud of a specific length between its open ends, the resilient gaskets are maintained under compression against surfaces 14*a* and 18*a* of printed circuit boards 14 and 18, respectively, when the connectors are mated. Gaskets 40 can be secured within recesses 42 by adhesives, ultrasonic welding or the like. With body 34 being fabricatable of relatively inexpensive plastic material, the savings can be applied to more expensive gaskets.

Generally, interengaging latch means are provided between housings 22 and 28 of connectors 12 and 16, respectively, to hold the connectors in mated condition. Specifically, referring to FIG. 4, a pair of latch bosses 44 project outwardly from each side of housing 22 of the receptacle connector. Opposite sides of housing 28 of the plug connector are provided with a pair of cut-outs which form latch shoulders 46. The dielectric housings may be molded of plastic material or the like, and latch bosses 44 can be chamfered, so that when the housings are mated, latch bosses 44 on housing 22 of the receptacle connector ride within housing 28 of the plug connector and "snap" into latching engagement with latch shoulders 46 when the two connectors are fully mated.

Figure 4:
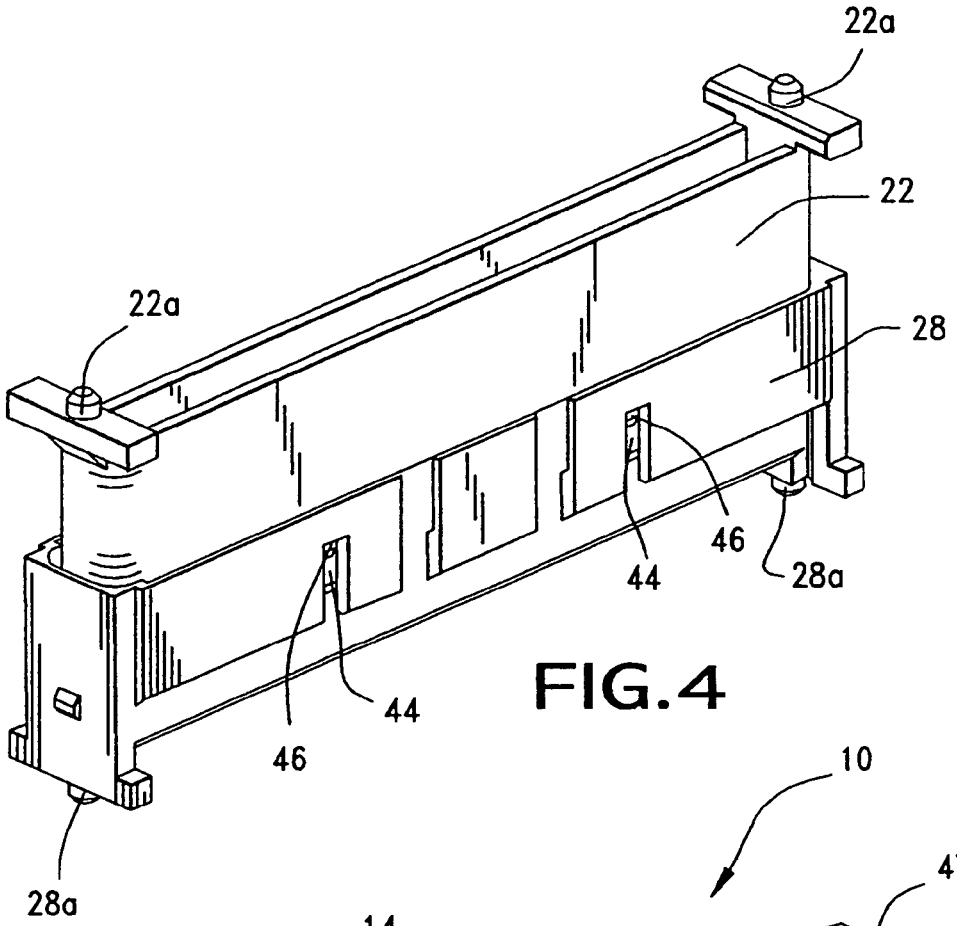
FIG. 4 is a perspective view of the housings of the two connectors to illustrate the interengaging latch means therebetween.

FIG. 4 shows that housing 22 of the receptacle connector has a pair of mounting posts 22*a* for insertion into a pair of mounting holes 47 (FIG. 5) in first printed circuit board 14. Housing 28 of the plug connector has a pair of mounting posts 28*a* for insertion into a pair of mounting holes (not visible) in second printed circuit board 18.

Generally, interengaging latch means are provided between the housing of at least one of the connectors and shroud 20 to hold the shroud about the one connector in engagement with its respective circuit board prior to mating the connectors. Specifically, referring to FIG. 5, opposite ends of housing 28 of plug connector 16 are provided with chamfered latch bosses 46 which project outwardly therefrom. Opposite ends of body 34 of shroud 20 are provided with complementary chamfered latch bosses 48 which project inwardly therefrom. Therefore, after plug connector 16 is mounted to printed circuit board 18 and terminal tail portions 30 are soldered to the circuit traces on the circuit board, shroud 20 can be assembled to plug connector 16 by interengaging latch bosses 46 and 48. The latch bosses will maintain the lower gasket 40 in compression against surface 18*a* of circuit board 18. The subassembly of plug connector 16 and shroud 20 then can be held easily by one hand of an operator while receptacle connector 12 is mated with plug connector 16 and surface 14*a* of printed circuit board 14 is brought into compression against the upper gasket 40 of the shroud to completely seal the inside of the shroud from the outside environment.

Finally, it can be seen in FIG. 5 that shroud 20 is sufficiently wide to enclose tail portions 30 and tail portions 24 (not visible in the drawing) of the terminals of the two connectors. Therefore, shroud 20 not only seals the mating connectors, themselves, from the outside environment, but the fragile connecting interfaces between the terminal tail portions and the circuit traces on the circuit boards are protected by the shroud and are sealed from the contaminants of the outside environment.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

What is claimed is:

1. A sealed electrical connector assembly for mounting between a pair of printed circuit boards, comprising:

a first electrical connector having a dielectric housing with a plurality of conductive terminals mounted therein which have tail portions for connecting to appropriate circuit traces on a first printed circuit board;

a second electrical connector mateable with the first connector and having a dielectric housing with a plurality of conductive terminals mounted therein which have tail portions for connecting to appropriate circuit traces on a second printed circuit board, said second printed circuit board being spaced from and generally parallel to the first printed circuit board when the connectors are mounted on their respective circuit boards and the connectors are mated together; and an open-ended, generally hollow shroud independent of and surrounding the mated connectors and configured to be positioned between the parallel printed circuit boards, the peripheral edges of open ends of the shroud being resilient and in engagement with opposing surfaces of the parallel printed circuit boards to seal the mating connectors disposed within the shroud from the outside environment.

2. The sealed electrical connector assembly of claim 1, including interengaging latch means between the housings of the first and second connectors to hold the connectors in mated condition.

3. The sealed electrical connector assembly of claim 1 wherein said shroud has a length between its open ends designed to place the resilient edges of the shroud under compression when the connectors are mated.

4. The sealed electrical connector assembly of claim 1, including interengaging latch means between the housing of at least one of the first and second connectors and the shroud to hold the shroud about the one connector in engagement with its respective printed circuit board prior to mating the connectors.

5. The sealed electrical connector assembly of claim 1 wherein the resilient edges of said shroud are provided by resilient gaskets secured about the edges of the open ends of the shroud.

6. A shroud for sealing first and second electrical connectors mounted between first and second circuit boards, the first electrical connector having a dielectric housing with a plurality of conductive terminals mounted therein which have tail portions for connecting to appropriate circuit traces on said first circuit board, the second electrical connector being mateable with the first connector and having a dielectric housing with a plurality of conductive terminals mounted therein which have tail portions for connecting to appropriate circuit traces on the second printed circuit board, the shroud comprising:

an open-ended, generally hollow body having oppositely facing, resilient peripheral edges, the body being configured to surround the mated connectors when said connectors are mounted between the first and second circuit boards, the body having a length between its open ends to place the resilient edges of the shroud under compression when the connectors are mated to seal the mating connectors disposed within the shroud from the outside environment.

7. The sealed electrical connector assembly of claim 6, including interengaging latch means between the housing of at least one of the first and second connectors and the shroud to hold the shroud about the one connector in engagement with its respective printed circuit board prior to mating the connectors.

8. The sealed electrical connector assembly of claim 6 wherein the resilient edges of said shroud are provided by resilient gaskets secured about the edges of the open ends of the shroud.

* * * * *